United States Patent [19]

Weidler

[11] Patent Number: 4,572,603

[45] Date of Patent: Feb. 25, 1986

[54] CONNECTOR FOR TERMINATING SMALL GAUGE MAGNET WIRE

[75] Inventor: Charles H. Weidler, Lancaster, Pa.

[73] Assignee: AMP, Incorporated, Harrisburg, Pa.

[21] Appl. No.: 625,997

[22] Filed: Jun. 29, 1984

[51] Int. Cl.[4] ..... H01R 4/24

[52] U.S. Cl. ..... 339/97 R

[58] Field of Search ..... 339/95–99, 339/200 R, 200 P

[56] References Cited

U.S. PATENT DOCUMENTS 2,929,043 3/1960 Phillips, Jr. ..... 339/99 R 3,397,380 8/1968 Puig ..... 339/99 R

*Primary Examiner*—Neil Abrams

*Attorney, Agent, or Firm*—Robert W. J. Usher

[57] ABSTRACT

An electrical connector assembly for small gauge magnet wire comprising a terminal (11) stamped and formed as a one-piece metal strip having a bowed wire engaging portion (14) with a convex, serrated, wire engaging surface (15) and mounting arms (16 and 17) extending in the direction of the bow from opposite ends. Both arms (16 and 17) are formed with wire receiving notches (20 and 21) and one arm (17) is hooked around an eccentric land (31) of a support (13) at one end of a wire supporting surface (26) while the other arm (16) is formed with a catch (22) engageable with a latching ramp (32) at the opposite end of the wire supporting surface (26). The terminal (11) is movable on the support (13) from a wire receiving position in which the wire engaging surface (15) is spaced from the wire supporting surface (26) for receiving a wire (12) extending through the notches (20 and 21) between the surfaces (15, 26) to a wire connecting position in which the wire (12) is clamped between the surfaces (15, 26) by engagement of the catch (22) with the latching ramp (32) in a detent action.

12 Claims, 4 Drawing Figures

CONNECTOR FOR TERMINATING SMALL GAUGE MAGNET WIRE

The invention relates to an electrical connector for terminating fine wires, for example magnet wires and, in particular, for terminating magnet wires of small gauge.

Magnet wires are fine wires having a single strand core covered by a thin layer of insulation such as varnish. Magnet wires of small gauge may have a core diameter as small as 0.0015 inches.

Various proposals have been made for terminating magnet wires with coil windings on stator housings, in particular, those described in U.S. Pat. No. 4,130,331 and 4,118,103 in which a wire is located across a gap in a cavity in an insulating housing formed integrally with the stator housing and a terminal having an open slot is inserted into the cavity so that opposite walls of the slot straddle the wire and penetrate the insulation to establish permanent electrical connection to the core. Tangs are provided on the terminal to engage the housing cavity wall during insertion into the housing to retain the terminal in the cavity terminating the wire.

However, a disadvantage of these prior proposals is that the walls or edges of the slot only effect connection to a relatively small area of wire core, i.e., at a single axial location on the wire. Furthermore, difficulties have been experienced in extending this technique to magnet wires of small gauge in view of their fragility.

One development of this technique is taught in U.S. Pat. No. 4,183,607 in which a wire supporting stuffer is received in the wire connecting slot itself in addition to the wire with the result that the wire is jammed between the wall of the stuffer and the slot wall.

Whilst this provides increased support for the wire during termination, connection is effected to only one side of the wire and the risk of severing the wire as a result of too large manufacturing tolerances remains.

In yet another proposal, terminals having substantially closed slots formed by shearing are used in an attempt to effect connection to the small gauge magnet wires. However, the last-mentioned proposal has still not been entirely satisfactory with the smallest gauge magnet wires having diameters of about 0.0015 inches.

In summary, all the above-mentioned proposals require the manipulation of very small parts with insulating houses moulded to very close tolerances while only a very small contact area is achieved. In view of the axial movement of the slot wall or edge transversely of the wire, there remains a risk of severing the wire if the tolerances are not met both in the parts and in the assembly tooling.

U.S. Pat. No. 4,026,013 describes another proposal which attempts to effect multiple connections to a magnet wire axially of its length by pressing the wire between the wall of a housing and a serrated wire engaging surface of a contact. However, the contact force is provided by deformation of the contact from a generally parallelogram configuration to a rectangular configuration during insertion of the contact into the housing by engagement of a leading corner of the contact with an end wall of the housing. This has not proved entirely satisfactory with the small gauge magnet wires in view of the relative movement and substantial forces are transmitted to the insulating housing which may cause damage thereto.

An object of the invention is to provide a connector for terminating small gauge magnet wire which connector is economical to manufacture and assemble by conventional mass production techniques, and which makes multiple connections with the wire along its length without risk of breaking the wire.

According to one aspect of the invention, there is provided an electrical connector for small gauge magnet wire comprising a resilient metal terminal stamped and formed in one piece with a strip-form wire engaging portion having a wire engaging surface provided with transverse serrations and an insulating support having an elongate wire supporting surface, the terminal and support being provided with cooperable mounting means whereby the terminals can be moved when mounted on the support from a first, wire receiving position in which the wire engaging surface is in spaced apart face-to-face relation to the wire supporting surface providing a wire admitting space therebetween to a second, wire connecting position in which the wire engaging surface is forced against a wire extending along the wire supporting surface so that the serrations penetrate the insulation of the wire to effect multiple connections along its length, the movement of the wire engaging surface from the first to the second position being substantially perpendicular to the wire.

As the movement of the wire engaging surface is substantially perpendicular to the wire, any risk of fracturing the wire is avoided.

Preferably, the mounting means comprises first and second arms extending transversely in the same direction from respective opposite ends of the wire engaging portion and arranged to grip sides of the support at locations adjacent opposit ends of the wire supporting surface in the first and second positions of the terminal.

Desirably, the mounting means on the support includes a ramp on one side and the first arm is provided with a catch arranged to ride over the ramp during movement of the terminal from the first to the second position and to engage an exit side of the ramp to secure the terminal in the second position. The ramp may have a cam entry end and an abrupt exit end forming a latching shoulder engaged by the catch in a snap action during the movement from the first to the second position.

Preferably, the wire engaging portion is bowed presenting a convex wire engaging surface to the wire support surface, movement of the first arm over the ramp causing the radius of curvature of the wire engaging portion to change from a maximum to a minimum.

The change in curvature of the wire engaging portion assists in pressing the surface against the wire while a resultant small shift in the serrations longitudinally of the wire may assist in penetration of the insulation.

An example of a connector according to the invention will now be described with reference to the accompanying drawings in which.

Figure 1:
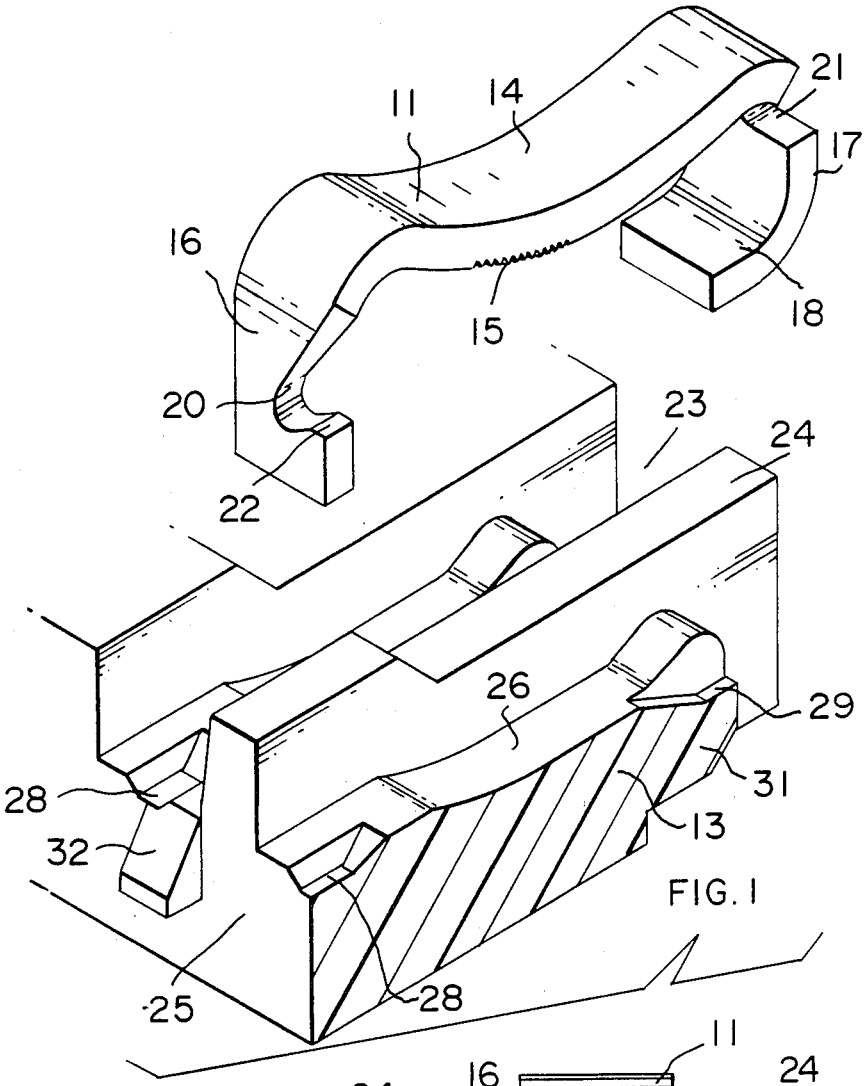
FIG. 1 is an isometric view of the connector assembly.
Figure 4:
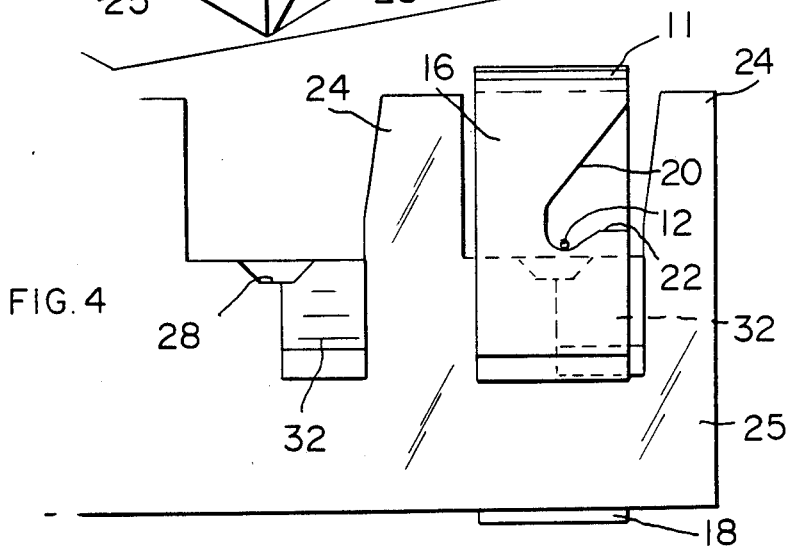
FIG. 4 is an end view of the assembly in the wire receiving position.
Figure 2:
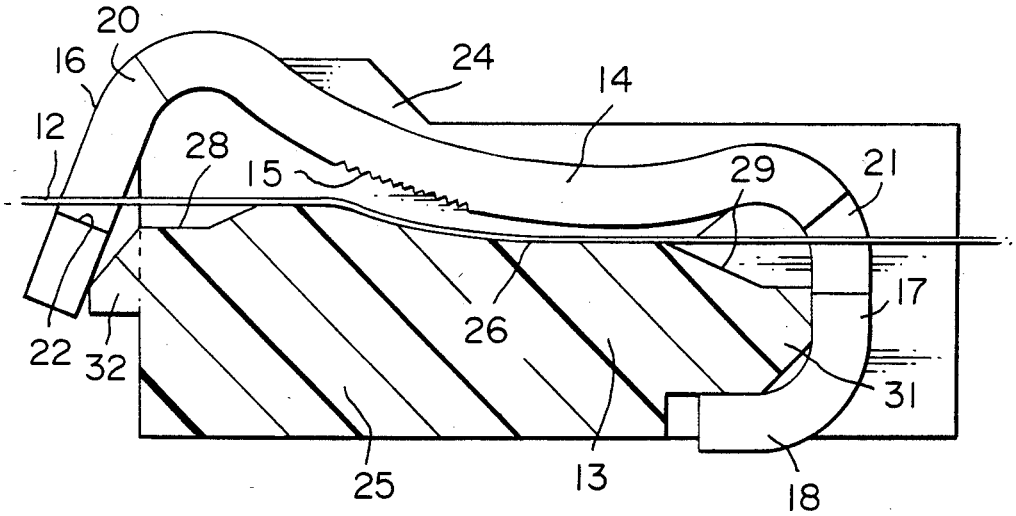
FIG. 2 is a side elevation partly in cross-section with the assembly in a wire receiving position.
Figure 3:
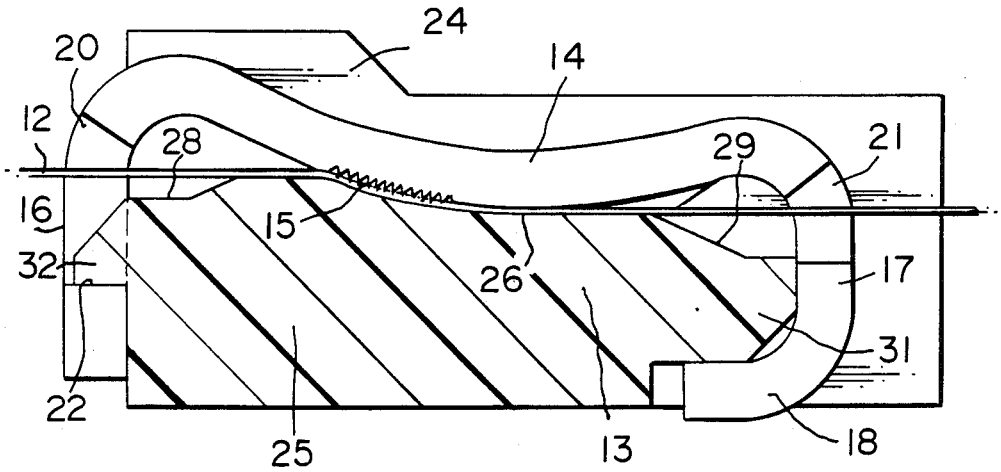
FIG. 3 is a similar view to FIG. 2 but with the assembly in a wire connecting position.

The electrical connector comprises a terminal 11 adapted to be clipped onto a magnet wire 12 extending along a support 13.

The terminal 11 is stamped and formed as a one-piece, resilient, metal strip with a substantially central, bowed, wire engaging portion 14 having a convex, transversely serrated wire engaging surface 15. The strip is bent at opposite ends to provide first and second arms 16 and 17 respectively extending in the direction of the bow, the second arm 17 being reversely bent to form a hook, the free end of which constitutes a pad 18 for surface connection to a printed circuit board or flat flexible cable. Wire receiving notches 20, 21 extend laterally into the arms 16 and 17 respectively, adjacent their root ends and one edge 22 of the notch 16 in the first arm is shaped to provide a catch as explained below.

The support 13 is moulded from suitable insulating material, preferably as an integral part of a stator housing, and is formed with a row of terminal receiving compartments 23 defined by parallel barriers 24 which upstand from a body portion 25. In each compartment 23, the body portion 25 is formed with a centrally located, concave, wire supporting surface 26 complementary to the curvature of the wire engaging surface 15 and is formed with recesses 28 and 29 at respective opposite ends to provide wire clearance. The recess 29 is formed in an eccentric terminal locating land 31 which protrudes from one side of the body. A latching ramp 32 protrudes from the other side of the body and has a cam entry end 33 and an abrupt exit defining a latching shoulder 34.

The terminal 11 is mounted on the housing in a first wire receiving position by the land 31 being received in an interference fit in the hooked arm 17 and the first arm 16 engaging the entry end of the ramp 32 so that the body 25 is gripped between the arms 16 and 17 with the wire engaging surface 14 in spaced face-to-face relation with the wire supporting surface 26. In this position a wire 12 can be drawn down laterally into the notches 20 and 21 to extend between the two surfaces. A force is then applied to the terminal adjacent the first arm 16 forcing the free end of the arm over the ramp which places the wire engaging portion in tension until the catch portion 22 snaps into latching engagement with the shoulder 34 driving the wire engaging surface 15 against the wire 12 so that the serrations will penetrate the insulation and effect multiple connections to the wire core along its length. Penetration is aided by the increased curvature of the wire engaging portion during the movement off the ramp and may be assisted by limited longitudinal shift in the serrations along the wire. As the pad 18 on the free end of the arm 17 is proud of the underside of the insulating support, the assembly can be applied directly to the face of a printed circuit board with the pad effecting surface connection with the board.

The substantially perpendicular nature of the relative movement of the wire engaging and supporting surfaces together avoids any longitudinal movement sufficient to risk breaking the wire while many discrete areas of connection are obtained.

The connector can be manufactured and assembled using conventional stamping, forming and moulding techniques applicable to economic mass production without a need to hold very close tolerances.

A further advantage is that the force transmitted to the insulating support will be relatively small in view of the use of the resilient energy stored in the terminal during movement to the wire connecting position and which provides both an impact force on the wire and contact pressure.

What is claimed is:

1. An electrical connector for small gauge magnet wire comprising a resilient metal terminal stamped and formed in one piece with a strip-form wire engaging portion, a wire engaging surface of the strip-form wire engaging portion being provided with transverse serrations and an insulating support having an elongate wire supporting surface, the terminal and support being provided with cooperable mounting means whereby the terminal can be moved when mounted on the support from a first, wire receiving position in which the wire engaging surface is in spaced apart face-to-face relation to the wire supporting surface providing a wire admitting space therebetween to a second, wire connecting position, in which the wire engaging surface is forced with resilient flexure against a wire extending along the wire supporting surface so that the serrations penetrate the insulation of the wire to effect multiple connections along its length, the movement of the wire engaging surface from the first to the second position being substantially perpendicular to the wire, the mounting means comprising first and second arms extending transversely in the same direction from respective opposite ends of the wire engaging portion and arranged to grip sides of the support at locations adjacent opposite ends of the wire supporting surface in the first and second positions of the terminal.

2. An electrical connector according to claim 1 in which the mounting means on the support includes a ramp on one side and the first arm is provided with a catch arranged to ride over the ramp during movement of the terminal from the first to the second position and to engage an exit side of the ramp to secure the terminal in the second position.

3. An electrical connector according to claim 2 in which the ramp has a cam entry end and an abrupt exit end forming a latching shoulder engaged by the catch in a snap action during the movement from the first to the second position.

4. An electrical connector according to claim 2 in which the wire engaging portion is bowed presenting a convex surface to the wire supporting surface, movement of the first arm over the ramp causing the radius of curvature of the wire engaging portion to change from a maximum to a minimum.

5. An electrical connector according to claim 2 in which the second arm is hooked around the other side of the support thereby locating the terminal on the support in the wire receiving position.

6. An electrical connector according to claim 4 in which the second arm is hooked around the other side of the support in an interference fit to secure the terminal in stressed condition in both first and second positions of the terminal.

7. An electrical connector according to claim 4 in which a free end of the second arm provides a contact pad for surface connection to a printed circuit board.

8. An electrical connector according to claim 3 in which the wire supporting surface is of concave shape, complementary to the wire engaging surface.

9. An electrical connector according to claim 7 in which the support is recessed adjacent opposite ends of the wire supporting surface to provide clearance for insertion of the wire into the notches.

10. An electrical connector according to any one of claims 2 to 9 in which the arms are formed with laterally extending wire receiving notches aligned to permit a wire to be drawn laterally into the wire receiving space between the wire engaging surface and the wire supporting surface.

11. An electrical connector assembly for small gauge magnet wire comprising:

a one-piece stamped and formed metal strip having a central elongate wire engaging portion bowed to present a convex wire engaging surface provided with transverse serrations, opposite ends of the strip being bent to form first and second arms extending transversely of the wire engaging portion in the direction of the bow, aligned wire receiving notches being formed in the arms, the second arm being hooked and the first arm being provided with a catch adjacent its free end, a support moulded of insulating material with a central wire supporting surface, a latching ramp on one side adjacent a first end of the surface and an eccentric land on the other side, adjacent an opposite end of the surface, the terminal being mounted on the support with the land received in the hooked portion in an interference fit, the wire engaging portion of the terminal being resiliently deformable to enable pivotal movement of the first arm from a first, wire receiving position, in which the first arm engages an entry end of the ramp with the wire engaging surface in spaced apart face-to-face relation with the wire supporting surface providing a wire admitting space therebetween, to a second, wire connecting position, in which it engages an exit end of the ramp with the wire engaging surface forced against a wire supported along the wire supporting surface with the serrations penetrating the insulation of the wire and effecting multiple connections along its length.

12. An electrical connector comprising an insulating housing support having an elongate wire supporting surface and terminal locating portions at opposite ends and, a terminal clip stamped and formed as a one-piece metal strip with a bowed, elongate, wire engaging portion having a wire engaging surface with transverse serrations, first and second arms extending from opposite ends of the strip in the direction of the bow, and aligned wire receiving notches extending laterally into each arm from the same direction, the second arm being hooked and fixed around one locating portion and the first arm having a catch whereby the wire engaging portion can be clipped against a wire extending through the notches and supported along the wire supporting surface by engagement of the other locating portion and the catch so the serrations effect multiple connections to the wire along its length.

* * * * *